US006723027B1

(12) United States Patent
Lo

(10) Patent No.: US 6,723,027 B1
(45) Date of Patent: Apr. 20, 2004

(54) TREADMILL HAVING A FOLDING MECHANISM

(76) Inventor: Chiu Hsiang Lo, No. 20, Lane 305, Sec. 3, Jungshan Rd., Tantz Shiag, Taichung Hsien (TW), 427

( * ) Notice: Subject to any disclaimer, the term of this patent is extended or adjusted under 35 U.S.C. 154(b) by 0 days.

(21) Appl. No.: 10/285,533

(22) Filed: Nov. 1, 2002

(51) Int. Cl.[7] ..... A63B 22/02
(52) U.S. Cl. ..... 482/54
(58) Field of Search ..... 482/51, 54

(56) References Cited

U.S. PATENT DOCUMENTS 6,213,919 B1 * 4/2001 Wang et al. ..... 482/54
6,325,745 B1 * 12/2001 Yu ..... 482/54
6,387,016 B1 * 5/2002 Lo ..... 482/54
6,579,211 B2 * 6/2003 Wu ..... 482/54
6,638,200 B2 * 10/2003 Chang ..... 482/54

* cited by examiner

*Primary Examiner*—Stephen R. Crow
(74) *Attorney, Agent, or Firm*—Rosenberg, Klein & Lee

(57) ABSTRACT

A treadmill having a folding mechanism includes a base, a support frame pivotally mounted on the base, and a folding mechanism mounted between the base and the support frame. The base is provided with two opposite guide tracks. The folding mechanism includes two opposite first levers, two opposite second levers, two limit levers, and a telescopic control handle. Thus, the folding mechanism is folded and unfolded rapidly, easily and conveniently. In addition, the support frame is folded rapidly and automatically without needing a positioning device, thereby facilitating the user folding the treadmill, and thereby decreasing the cost of fabrication.

6 Claims, 4 Drawing Sheets

TREADMILL HAVING A FOLDING MECHANISM

BACKGROUND OF THE INVENTION

1. Field of the Invention

The present invention relates to a treadmill having a folding mechanism, and more particularly to a treadmill having a folding mechanism that is folded and unfolded rapidly, easily and conveniently.

2. Description of the Related Art

A conventional treadmill includes a folding mechanism that is provided with a pivot shaft or is driven by a motorized member to fold the treadmill. However, the conventional folding mechanism cannot be operated and folded easily and conveniently, thereby causing inconvenience to the user. In addition, the conventional folding mechanism has a very complicated construction, and is easily worn out, thereby increasing the cost of fabrication.

SUMMARY OF THE INVENTION

The present invention has arisen to mitigate and/or obviate the disadvantage of the conventional folding mechanism for a treadmill.

The primary objective of the present invention is to provide a treadmill having a folding mechanism that is folded and unfolded rapidly, easily and conveniently.

Another objective of the present invention is to provide a treadmill having a folding mechanism, wherein the support frame is folded rapidly and automatically without needing a positioning device, thereby facilitating the user folding the treadmill, and thereby decreasing the cost of fabrication.

A further objective of the present invention is to provide a treadmill having a folding mechanism, wherein the telescopic control handle of the folding mechanism is rested on the support frame, thereby preventing the support frame from falling down.

A further objective of the present invention is to provide a treadmill having a folding mechanism, wherein the support frame is expanded downward conveniently by the cushioning effect of the telescopic control handle of the folding mechanism, thereby saving the manual work, and thereby preventing the support frame from being damaged.

In accordance with the present invention, there is provided a treadmill having a folding mechanism, comprising a base, a support frame pivotally mounted on the base, and a folding mechanism mounted between the base and the support frame, wherein:

the base is provided with two opposite guide tracks;

the folding mechanism includes two opposite first levers, two opposite second levers, two limit levers, and a telescopic control handle, wherein:

each of the two opposite first levers of the folding mechanism has a first end slidably mounted on a respective one of the two opposite guide tracks of the base, and a second end pivotally mounted on a bottom of the support frame;

each of the two opposite second levers of the folding mechanism has a first end slidably mounted on a respective one of the two opposite guide tracks of the base, and a second end pivotally mounted on the bottom of the support frame;

each of the two limit levers of the folding mechanism has a first end slidably mounted on a respective one of the two opposite guide tracks of the base, and a mediate portion pivotally mounted on the mediate portion of a respective one of the two opposite first levers of the folding mechanism; and the telescopic control handle of the folding mechanism is pivotally on the second end of one of the two opposite first levers of the folding mechanism, and is located adjacent to the bottom of the support frame.

Further benefits and advantages of the present invention will become apparent after a careful reading of the detailed description with appropriate reference to the accompanying drawings.

DETAILED DESCRIPTION OF THE INVENTION

Figure 1:
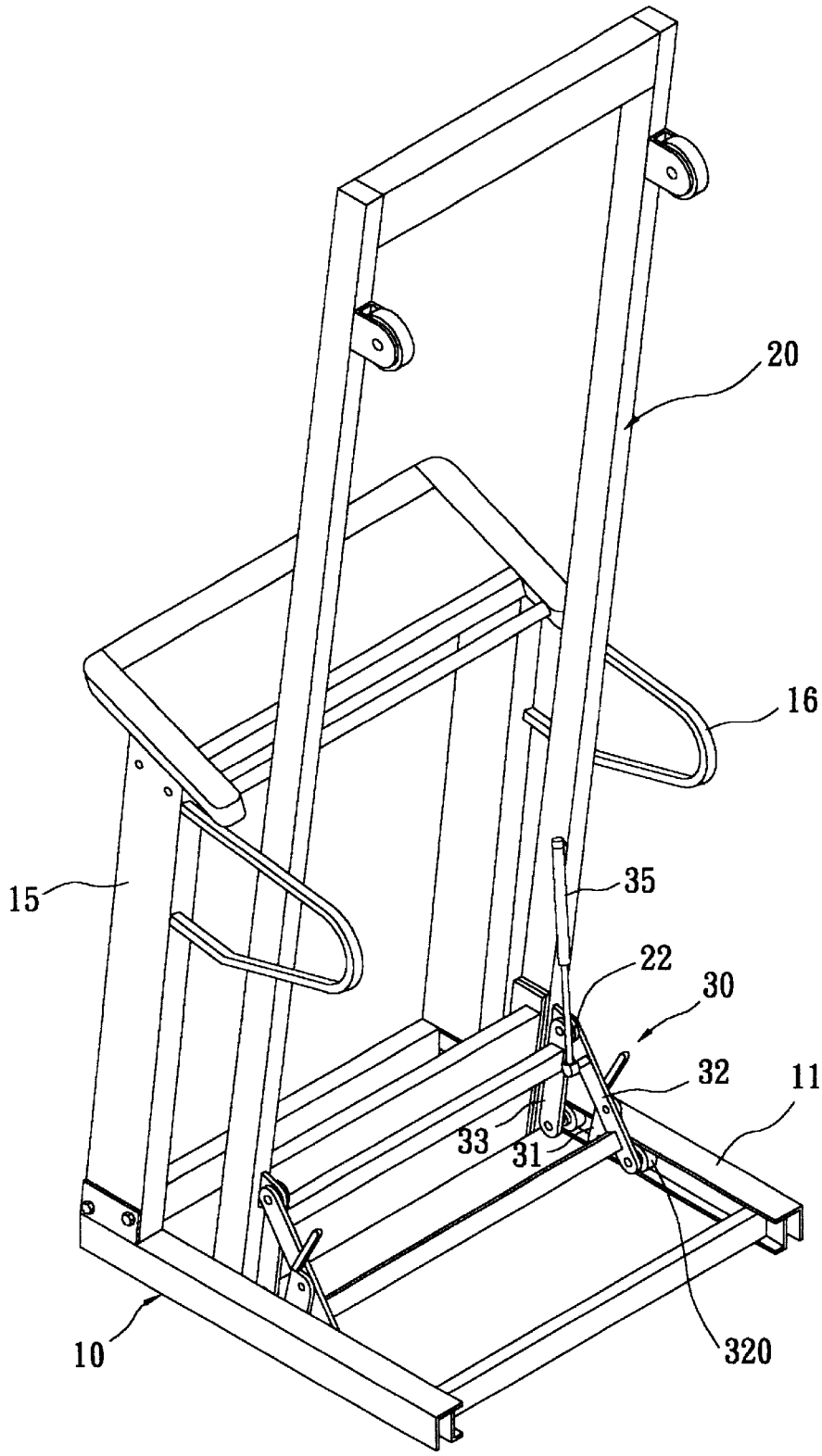
FIG. 1 is a perspective view of a treadmill having a folding mechanism in accordance with a preferred embodiment of the present invention.
Figure 2:
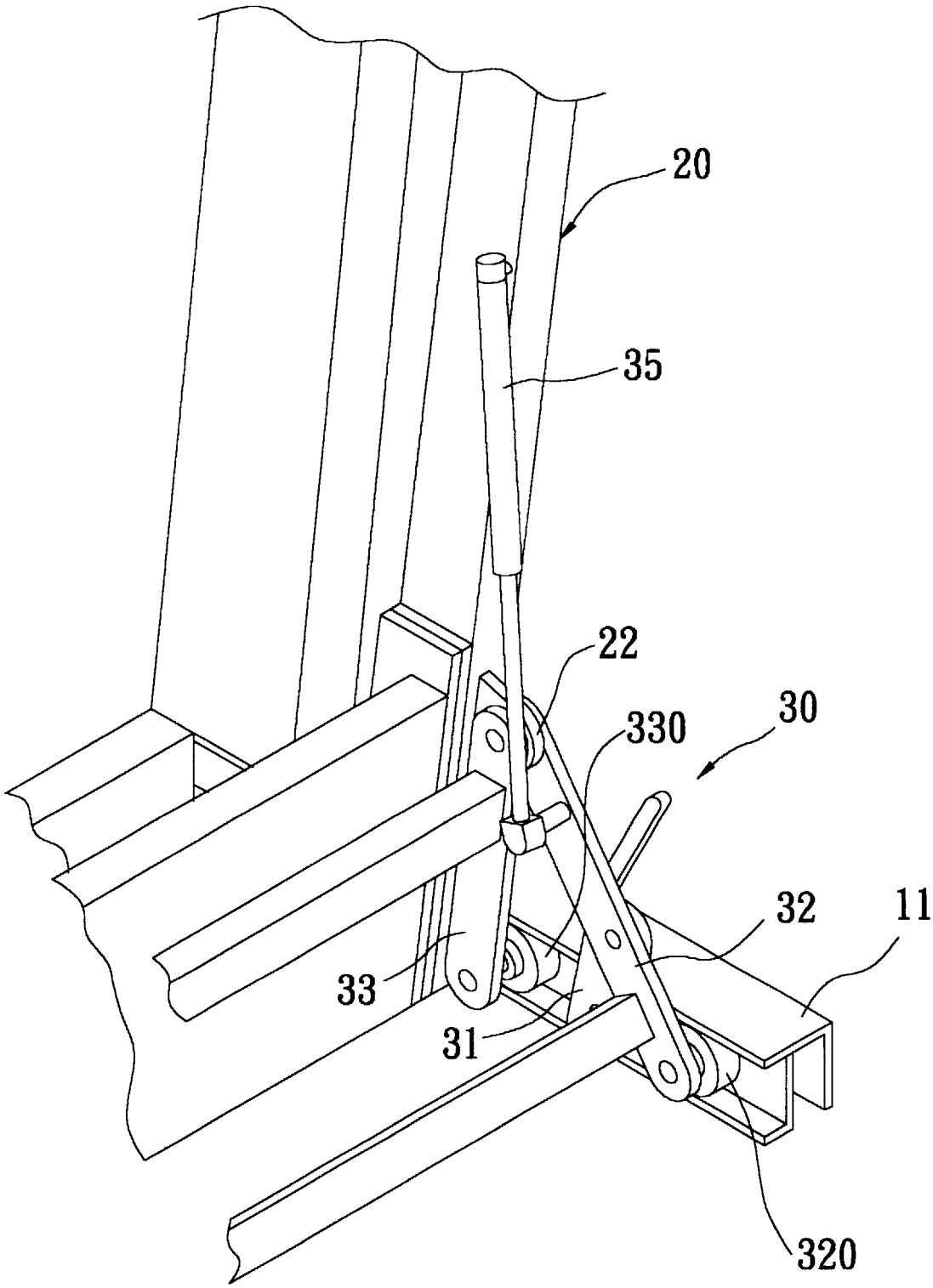
FIG. 2 is a partially enlarged view of the treadmill having a folding mechanism as shown in FIG. 1.
Figure 3:
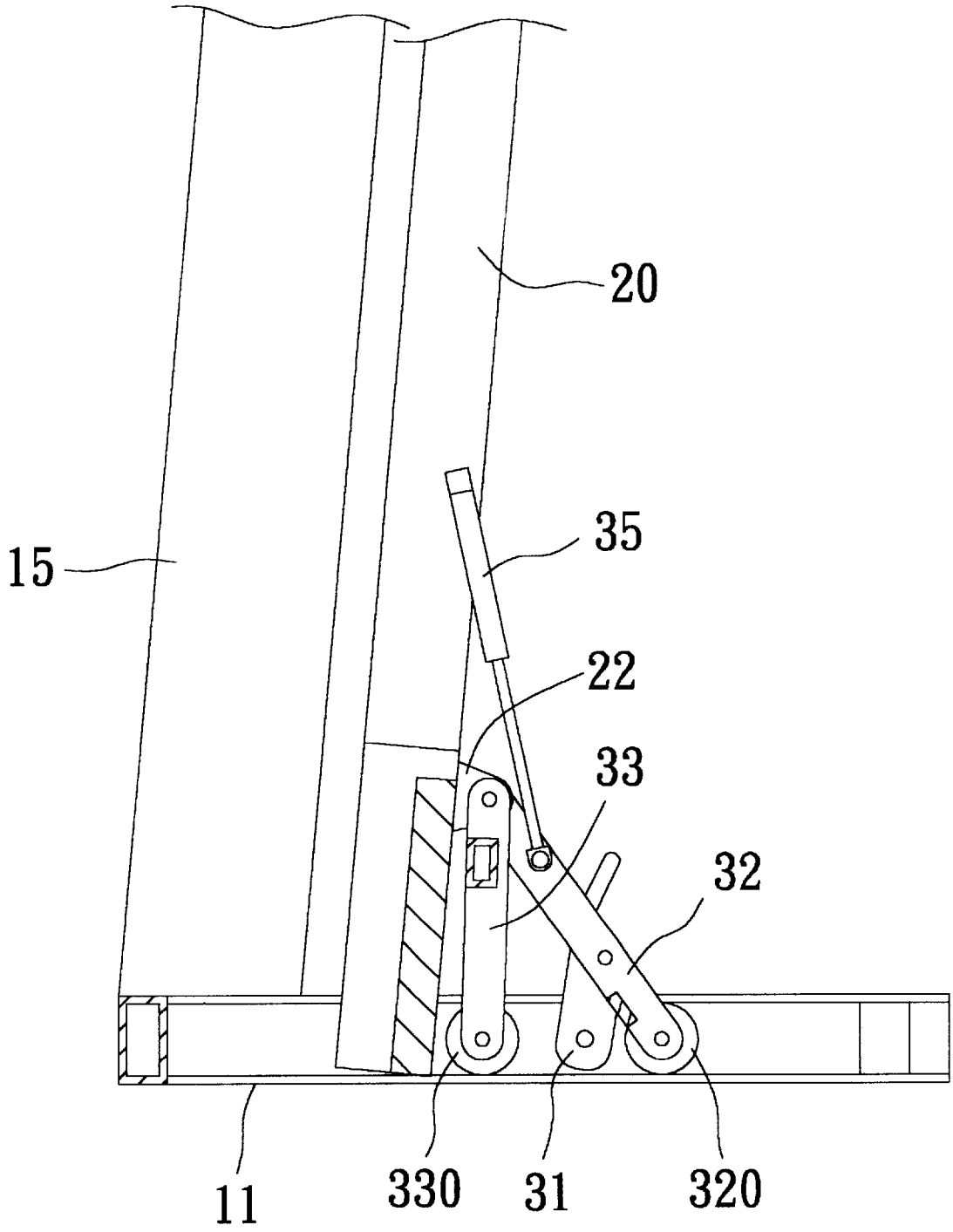
FIG. 3 is a side plan cross-sectional view of the treadmill having a folding mechanism as shown in FIG. 2.

Referring to the drawings and initially to FIGS. 1–3, a treadmill having a folding mechanism in accordance with a preferred embodiment of the present invention comprises a base 10, a control station 15 mounted on the front end of the base 10, two armrests 16 mounted on two opposite sides of the control station 15, and a support frame 20 pivotally mounted on the base 10 for mounting a treading belt (not shown). The base 10 is provided with two opposite guide tracks 11.

The treadmill further comprises a folding mechanism 30 mounted between the base 10 and the support frame 20. The folding mechanism 30 includes two opposite first levers 32, two opposite second levers 33, two limit levers 31, and a telescopic control handle 35.

Each of the two opposite first levers 32 of the folding mechanism 30 has a first end slidably mounted on a respective one of the two opposite guide tracks 11 of the base 10, and a second end pivotally mounted on a bottom of the support frame 20. The first end of each of the two opposite first levers 32 of the folding mechanism 30 is provided with a first roller 320 slidably mounted on a respective one of the two opposite guide tracks 11 of the base 10.

Each of the two opposite second levers 33 of the folding mechanism 30 has a first end slidably mounted on a respective one of the two opposite guide tracks 11 of the base 10, and a second end pivotally mounted on the bottom of the support frame 20. The first end of each of the two opposite second levers 33 of the folding mechanism 30 is provided with a second roller 330 slidably mounted on a respective one of the two opposite guide tracks 11 of the base 10.

Each of the two limit levers 31 of the folding mechanism 30 has a first end slidably mounted on a respective one of the two opposite guide tracks 11 of the base 10, and a mediate portion pivotally mounted on the mediate portion of a respective one of the two opposite first levers 32 of the folding mechanism 30. The first end of each of the two limit levers 31 of the folding mechanism 30 is located between the first end of a respective one of the two opposite first levers 32 and the first end of a respective one of the two opposite second levers 33. Thus, each of the two opposite first levers 32 and each of the two opposite second levers 33 are relatively folded or expanded outward about the respective limit lever 31.

The telescopic control handle 35 of the folding mechanism 30 is pivotally on the second end of one of the two opposite first levers 32 of the folding mechanism 30, and is located adjacent to the bottom of the support frame 20. The telescopic control handle 35 of the folding mechanism 30 may be expanded and extended outward automatically.

Preferably, the bottom of the support frame 20 is provided with two opposite pivot ears 22, so that the second end of each of the two opposite first levers 32 of the folding mechanism 30 is pivotally mounted on a respective one of the two pivot ears 22 of the support frame 20, and the second end of each of the two opposite second levers 33 of the folding mechanism 30 is pivotally mounted on a respective one of the two pivot ears 22 of the support frame 20.

In operation, referring to FIGS. 1–3, the user only needs to drive and move one of the two limit levers 31 of the folding mechanism 30, so that after the first lever 32 and the second lever 33 exceed the pivot point, the support frame 20 is pushed upward automatically by the action of the telescopic control handle 35 of the folding mechanism 30, thereby folding the support frame 20 as shown in FIG. 3. Thus, the support frame 20 is folded rapidly and automatically without needing a positioning device, thereby facilitating the user folding the treadmill, and thereby decreasing the cost of fabrication. In addition, the telescopic control handle 35 of the folding mechanism 30 is rested on the support frame 20, thereby preventing the support frame 20 from falling down.

Figure 4:
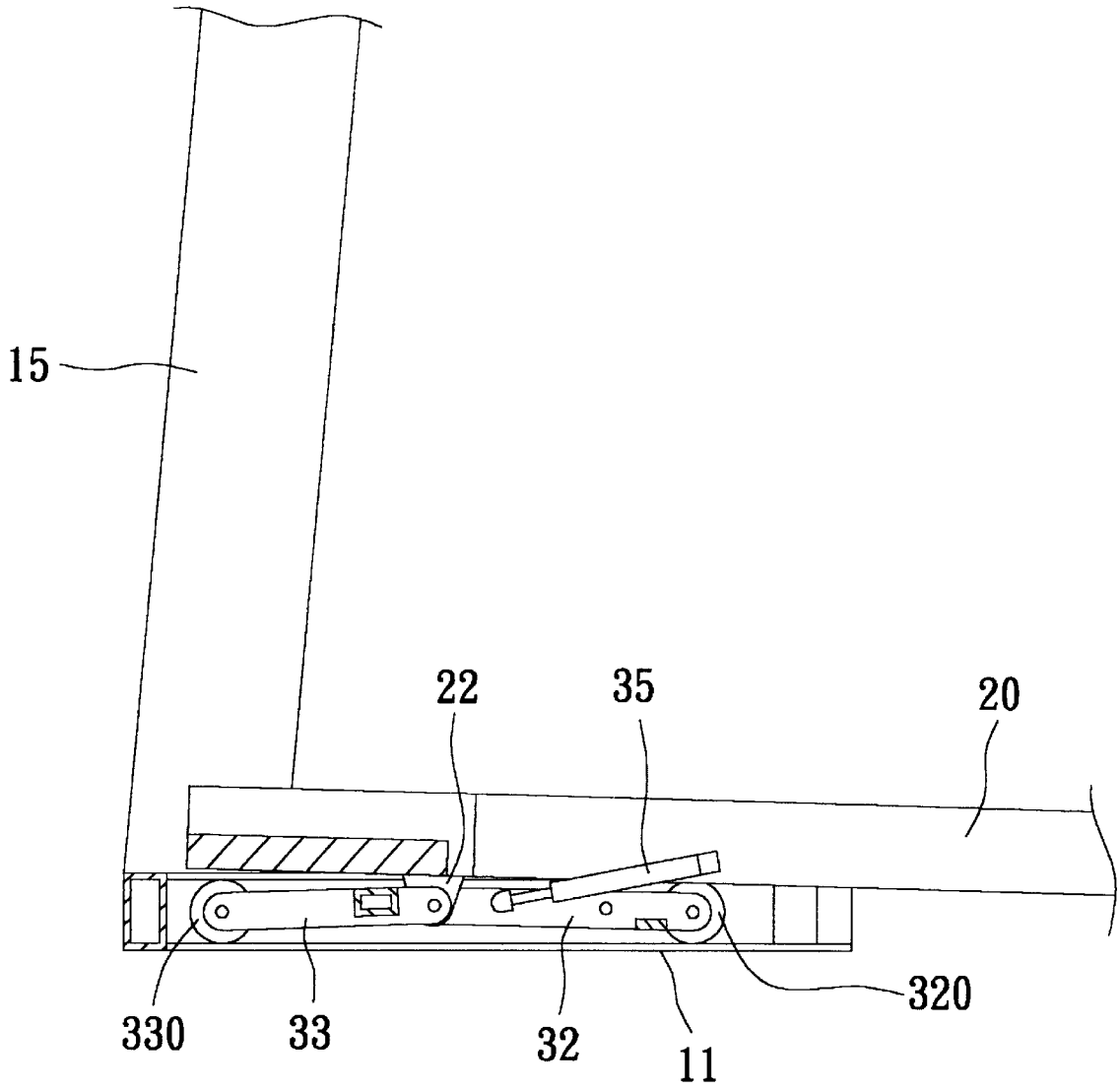
FIG. 4 is. a schematic operational view of the treadmill having a folding mechanism as shown in FIG. 3.

Referring to FIG. 4, with reference to FIGS. 1–3, the user only needs to drive the support frame 20 downward, so that the telescopic control handle 35 of the folding mechanism 30 is retracted, and each of the two opposite first levers 32 and each of the two opposite second levers 33 of the folding mechanism 30 are expanded by the weight of the support frame 20. Thus, the support frame 20 is expanded downward conveniently by the cushioning effect of the telescopic control handle 35 of the folding mechanism 30, thereby saving the manual work, and thereby preventing the support frame 20 from being damaged.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A treadmill having a folding mechanism, comprising a base, a support frame pivotally mounted on the base, and a folding mechanism mounted between the base and the support frame, wherein:

the base is provided with two opposite guide tracks;

the folding mechanism includes two opposite first levers, two opposite second levers, two limit levers, and a telescopic control handle, wherein:

each of the two opposite first levers of the folding mechanism has a first end slidably mounted on a respective one of the two opposite guide tracks of the base, and a second end pivotally mounted on a bottom of the support frame;

each of the two opposite second levers of the folding mechanism has a first end slidably mounted on a respective one of the two opposite guide tracks of the base, and a second end pivotally mounted on the bottom of the support frame;

each of the two limit levers of the folding mechanism has a first end slidably mounted on a respective one of the two opposite guide tracks of the base, and a mediate portion pivotally mounted on the mediate portion of a respective one of the two opposite first levers of the folding mechanism; and the telescopic control handle of the folding mechanism is pivotally on the second end of one of the two opposite first levers of the folding mechanism, and is located adjacent to the bottom of the support frame.

2. The treadmill having a folding mechanism in accordance with claim 1, wherein the first end of each of the two opposite first levers of the folding mechanism is provided with a first roller slidably mounted on a respective one of the two opposite guide tracks of the base.

3. The treadmill having a folding mechanism in accordance with claim 1, wherein the first end of each of the two opposite second levers of the folding mechanism is provided with a second roller slidably mounted on a respective one of the two opposite guide tracks of the base.

4. The treadmill having a folding mechanism in accordance with claim 1, wherein the first end of each of the two limit levers of the folding mechanism is located between the first end of a respective one of the two opposite first levers and the first end of a respective one of the two opposite second levers.

5. The treadmill having a folding mechanism in accordance with claim 1, wherein each of the two opposite first levers and each of the two opposite second levers are relatively folded or expanded outward about the respective limit lever.

6. The treadmill having a folding mechanism in accordance with claim 1, wherein the bottom of the support frame is provided with two opposite pivot ears, so that the second end of each of the two opposite first levers of the folding mechanism is pivotally mounted on a respective one of the two pivot ears of the support frame, and the second end of each of the two opposite second levers of the folding mechanism is pivotally mounted on a respective one of the two pivot ears of the support frame.

* * * * *